US005819968A

United States Patent [19]

Jones

[11] Patent Number: 5,819,968

[45] Date of Patent: Oct. 13, 1998

[54] SENIOR FRIENDLY CHILD RESISTANT MEDICATION CONTAINERS

[76] Inventor: William Thomas Jones, 38 Redford Road, London, Ontario, Canada, N3X 3V5

[21] Appl. No.: 812,835

[22] Filed: Mar. 6, 1997

[51] Int. Cl.[6] ..... B65D 55/02

[52] U.S. Cl. ..... 215/222; 215/274; 215/332; 215/230; 116/309

[58] Field of Search ..... 216/204, 214, 216/216, 217, 218, 219, 220, 222, 223, 224, 225, 230, 274, 276, 277, 332, 341, 342, 349, 11.3, 351, 11.1, 11.6; 220/293, 281, 296, 298, 302, 304; 116/306, 308, 309, 311, 312, 315, 318

[56] References Cited

U.S. PATENT DOCUMENTS

| | | | |
|---|---|---|---|
| 3,072,276 | 1/1963 | Nichols | 215/222 |
| 3,623,623 | 11/1971 | Bauer | 215/222 X |
| 4,049,148 | 9/1977 | Suhr et al. | 215/222 X |
| 4,128,184 | 12/1978 | Northup | 215/222 |
| 4,346,809 | 8/1982 | Kusz | 215/222 X |
| 4,393,977 | 7/1983 | Willingham | 215/220 X |
| 4,528,933 | 7/1985 | Allen . | |
| 4,666,051 | 5/1987 | Trick . | |
| 4,753,189 | 6/1988 | Mastman et al. . | |
| 5,197,616 | 3/1993 | Buono | 215/230 X |

*Primary Examiner*—Allan N. Shoap
*Assistant Examiner*—Nathan Newhouse
*Attorney, Agent, or Firm*—Roger & Scott

[57] ABSTRACT

A medication container has a tubular container body having an open upper end, and a cap detachably securable to the upper end of the container body by clockwise rotation relative thereto. The cap and the container body have mutually engageable stops preventing anti-clockwise opening rotation of the cap relative to the container body when the cap is in an upper position relative to the container body. A cap liner of resilient material is located within the cap and has a peripheral portion engageable with the upper end of the container body to close the upper end, the cap liner also having a central button portion projecting upwardly through a central aperture in the cap for manual engagement by a person wishing to open the container. The cap has a downward extending wall adjacent the aperture and engaged by the cap liner to maintain the cap in the upper position relative to the container body. Downward manual pressure on the central button portion of a cap liner causes resilient deformation of the cap liner away from the downwardly extending wall of the cap to permit the cap to be depressed from its upper position and thereby permit counter-clockwise opening rotation of the cap relative to the container body.

5 Claims, 7 Drawing Sheets

SENIOR FRIENDLY CHILD RESISTANT MEDICATION CONTAINERS

This invention relates to medication containers.

BACKGROUND OF THE INVENTION

Medication containers with child resistant closures, i.e. which resist opening by children, are well known. However, the features which render a closure child resistant often cause closure to be difficult to open by seniors, i.e. older people, especially those with weak manual dexterity.

It is also known to provide medication containers with mechanism operated by opening and/or closure to indicate the time the next dosage of medication is to be taken, such information being especially useful for seniors with failing memories as well as of course for others.

It is therefore an object of the invention to provide a medication container which is both senior friendly and child resistant, and which may also be provided with mechanism operated by opening and/or closure to indicate the next dosage time.

SUMMARY OF THE INVENTION

According to the invention, a medication container has a tubular container body having an open upper end, and a cap detachably securable to the upper end of the container body by clockwise rotation relative thereto. The cap and the container body have mutually engageable stops which prevent anti-clockwise opening rotation of the cap relative to the container body when the cap is in an upper position relative to the container body. A cap liner of resilient material is located within the cap and has a peripheral portion engageable with the upper end of the container body to close the upper end, the cap liner also having a central button portion projecting upwardly through a central aperture in the cap for manual engagement by a person wishing to open the container. The cap has a downwardly extending wall adjacent the aperture and engaged by the cap liner to maintain the cap in the upper position relative to the container body. Downward manual pressure on the central button portion of the cap liner causes resilient deformation of the cap liner away from the downwardly extending wall of the cap to permit the cap to be depressed from its upper position and thereby permit counter-clockwise opening rotation of the cap relative to the container body.

Thus, when the container is closed, a child cannot simply rotate the cap in a counter-clockwise direction to open the container, but the central button portion of the cap liner can be depressed to enable the cap also to be depressed and subsequently rotated in an opening manner, thereby facilitating opening movement by people such as seniors with weak manual dexterity.

The medication container may also include a disposal tubular body liner with a closed lower end and an open upper end located within the container body for containing medication, the body liner having a peripheral upper end portion urged against the container body by the cap liner to provide an airtight seal between the cap liner and the body liner. The container body may have an open lower end.

The cap and the cap liner may have inter-engaging mechanism preventing relative rotational movement therebetween when the cap is rotated in one direction relative to the container body and permitting relative rotation therebetween when the cap is rotated in an opposite direction relative to the container body, the cap and the cap liner having indicia which indicates the next dosage time when the cap is rotated in said opposite direction.

BRIEF DESCRIPTION OF THE DRAWINGS

Embodiments of the invention, will now be described, with reference to the accompanying drawings, of which.

DESCRIPTION OF PREFERRED EMBODIMENTS

Figure 1:
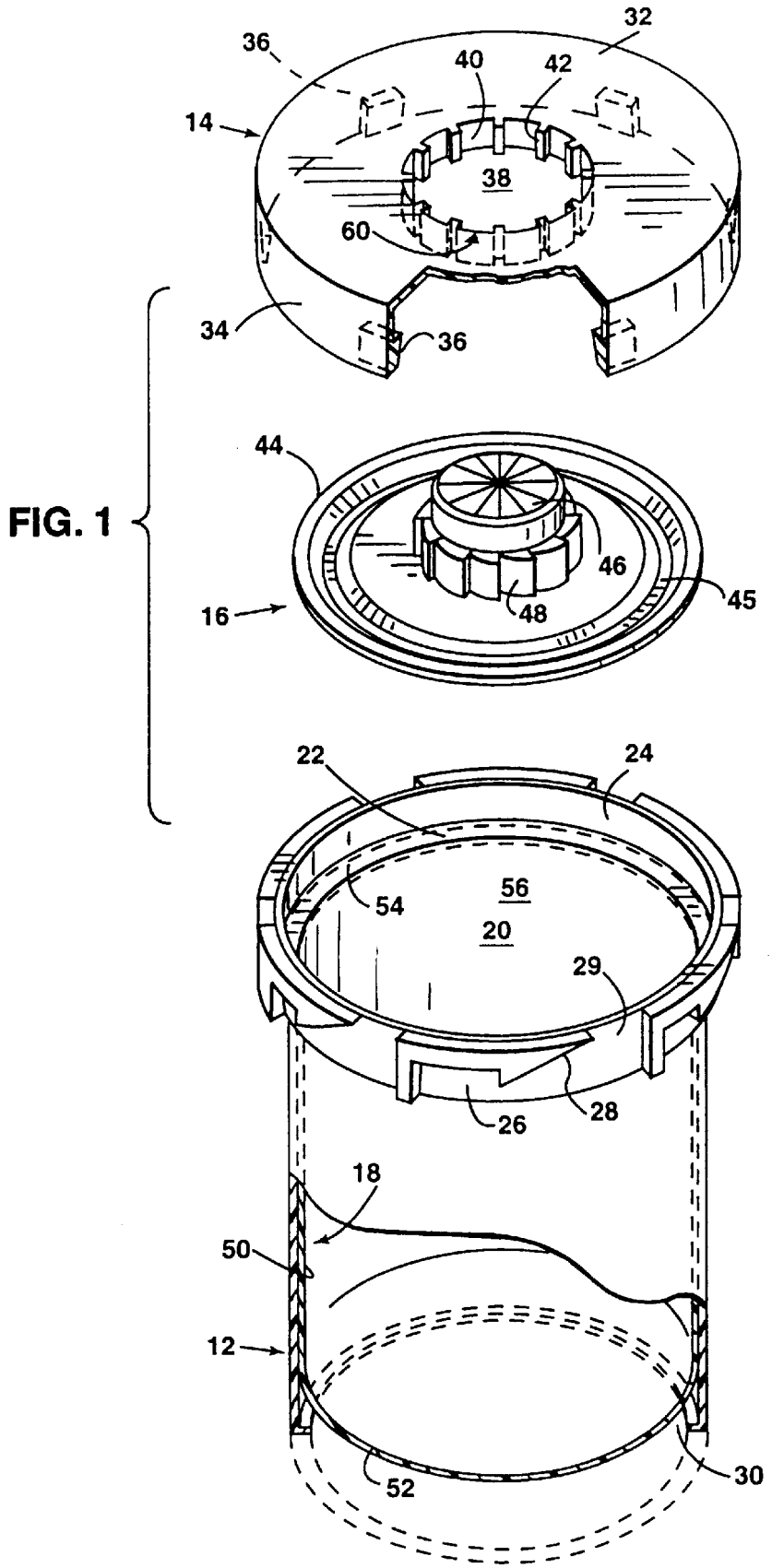
FIG. 1 is an exploded perspective view of a medication container in accordance with one embodiment of the invention.
Figure 2:
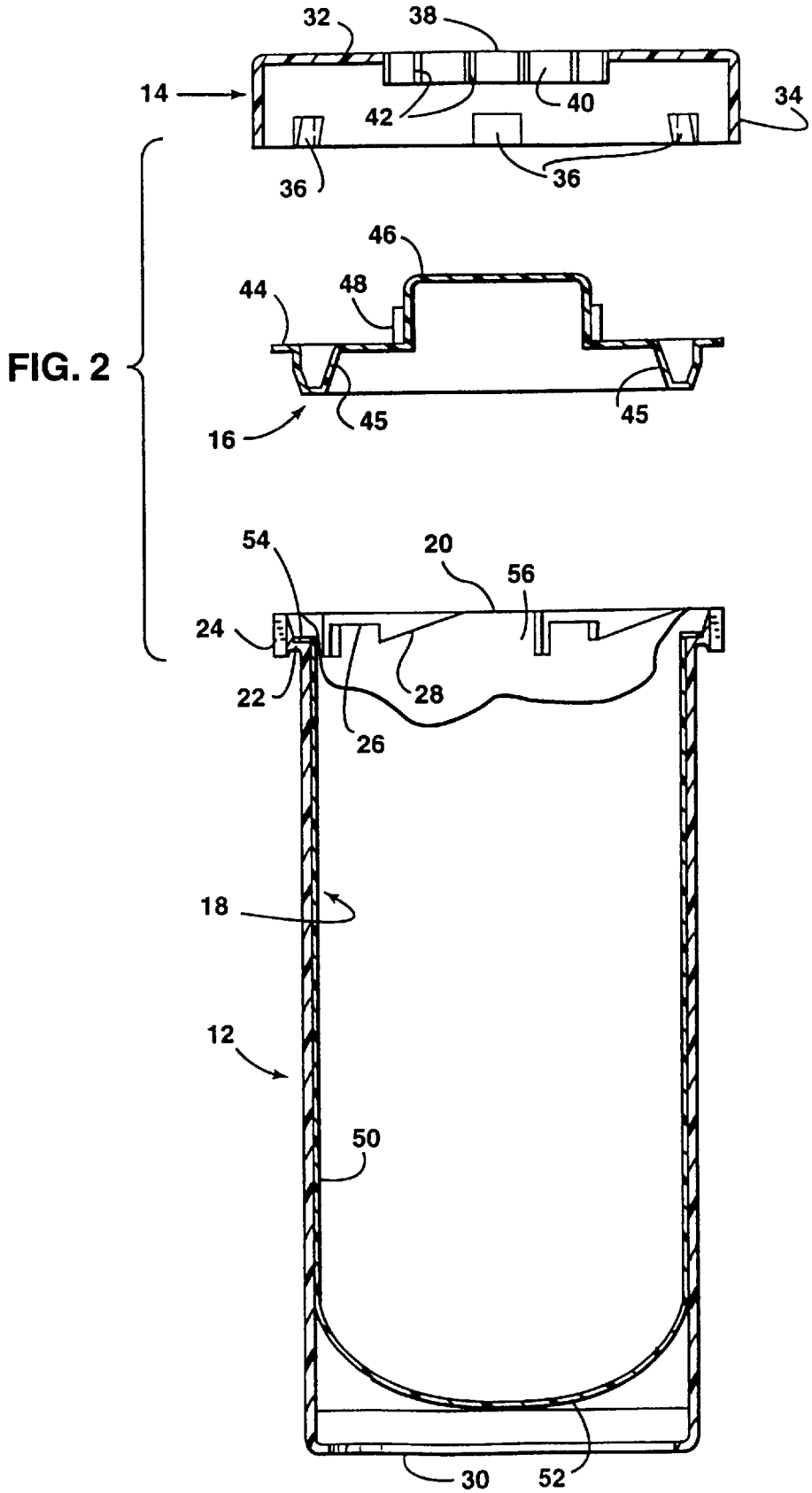
FIG. 2 is an exploded sectional view of the container.

Referring to the drawings, a medication container has a tubular container body 12, a cap 14, a cap liner 16 and a body liner 18. The container body 12 has an upper open end 20 with a peripheral outwardly extending flange 22 and an upwardly extending wall 24 extending around the radially outer edge of the flange 22. The external surface of the wall 24 has a series of circumferentially spaced downwardly open recesses 26 each with an adjacent upwardly inclined ramp 28, with each ramp being followed by a space 29. The lower end 30 of the container body 12 is open.

The cap 14 has a circular top portion 32 with a downwardly extending peripheral wall 34 having a series of inwardly projecting lugs 36 at its lower end equal in number to the number of recesses 26 in the exterior surface of the wall 24 at the upper end of the container body 12. The circular top portion 32 of the cap 14 also has a central aperture 38 and a downwardly extending inner wall 40 surrounding the aperture 38. The inner wall 40 has a series of circumferentially spaced vertical ribs 42 for a purpose to be described.

The cap liner 16 is of resilient material and is located within the cap 14, the cap liner 16 having a peripheral portion 44 engaging the upper end of the wall 24 of the container body 12 to close the upper end thereof, and a central button portion 46 projecting upwardly through the central aperture 38 in the cap 14. The button portion 46 has a series of ratchet teeth 48 extending around the side thereof for a purpose to be described. The cap liner 16 also has a downwardly projecting annular rib 45 immediately radially inwardly of the peripheral portion 44 for a purpose to be described.

The body liner 18 has a tubular body 50 which is a snug fit in the container body 12. The tubular body 50 has a closed lower end 52 and a peripheral outwardly extending flange 54 at its upper end 56. As clearly shown in FIG. 3, the flange 54 of the body liner 18 is sandwiched between the upper end of the container body 18 and the annular rib 45 of the cap liner 16.

Figure 6:
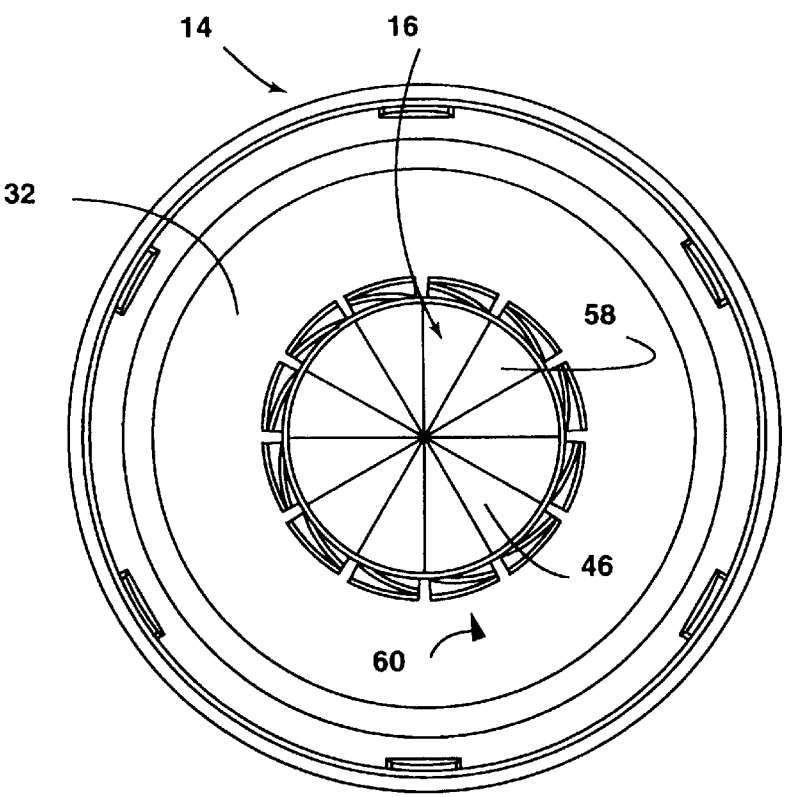
FIG. 6 is a similar view showing the cap in the open position.
Figure 5:
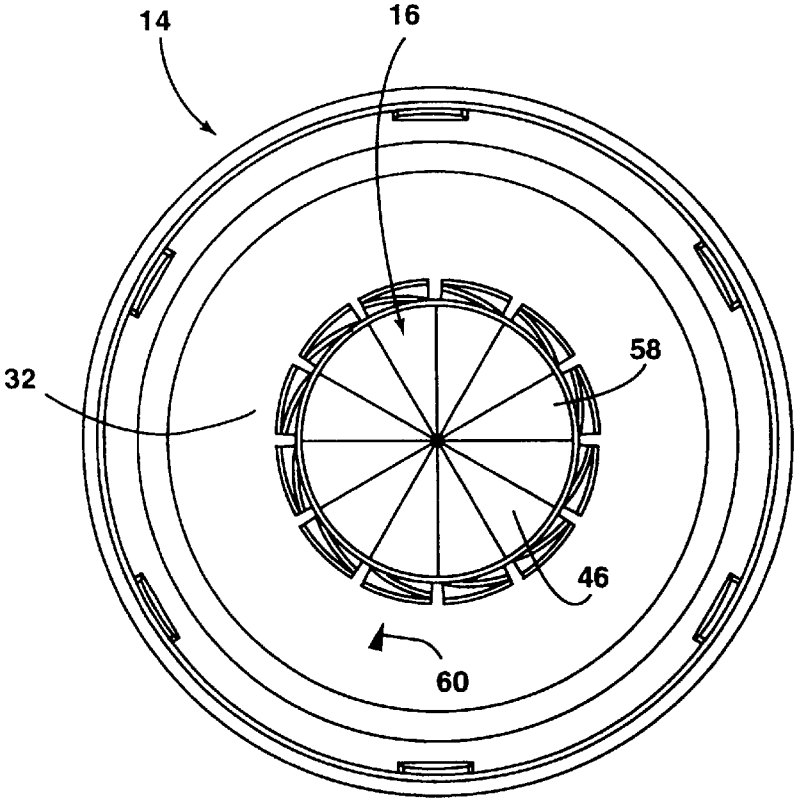
FIG. 5 is a top view of the container with the cap in the closed position.

As shown in FIGS. 5 and 6, a dosage indicator 58 is secured by adhesive to an upper surface of the button portion 46, and an indicator arrow 60 is marked on the top portion 32 of the cap 14 adjacent the central aperture 38.

Figure 3:
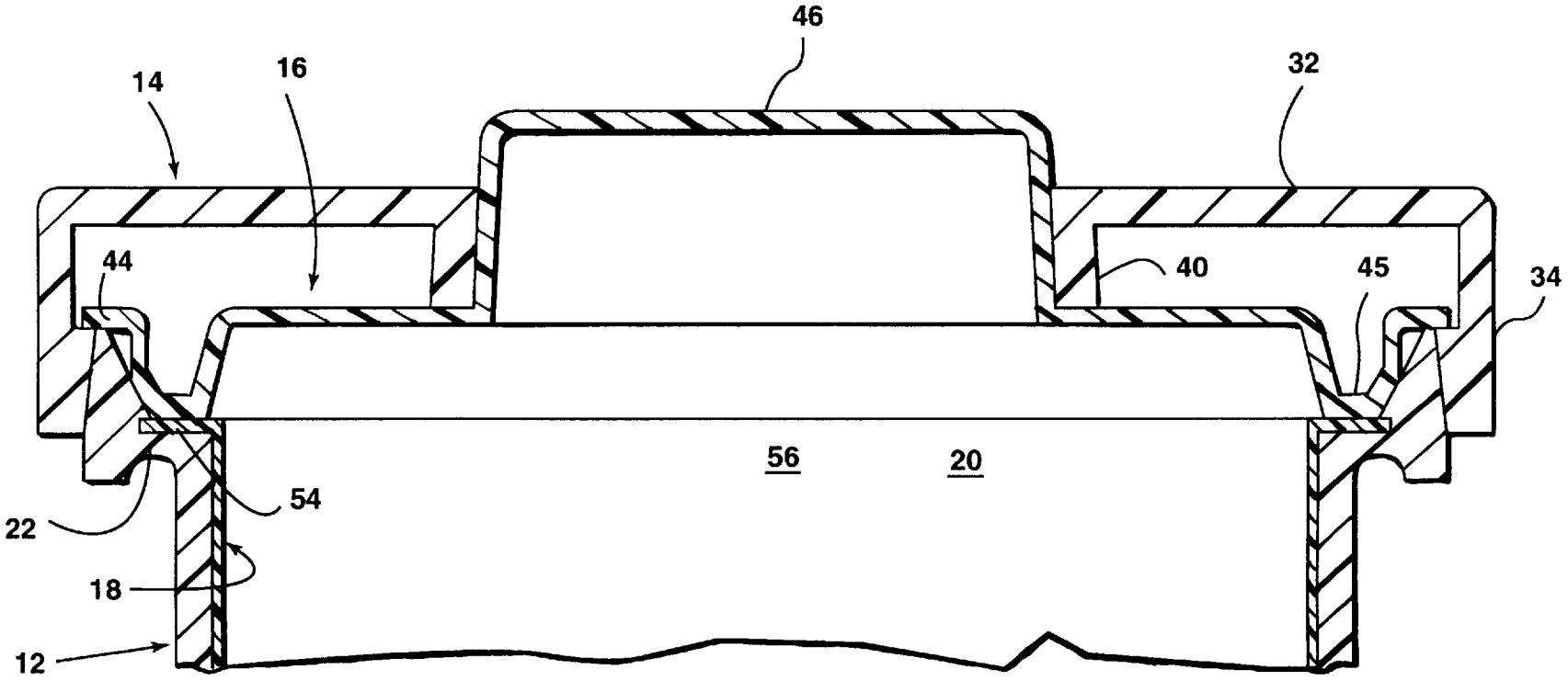
FIG. 3 is a sectional view of the upper portion of the container in the closed position.

FIGS. 3 and 5 show the medication container with the cap 14 and cap liner 16 in the closed condition. As can be clearly seen from FIG. 3, the cap liner 16 is engaging the lower end of the inner wall 40 of cap 14 to maintain the cap 14 in an upper position relative to the container body 12 with the lugs 36 on the cap 14 firmly engaged in the recesses 16 in the outer surface of the container body wall 24, thereby preventing the cap 14 from being rotated relative to the container body in the anti-clockwise opening direction. Also, in this configuration, the annular rib 45 of the cap liner 16 is pressing firmly down on the annular flange 54 of the body liner 18, which is seated on the flange 22 of the container body 12, thereby forming an airtight seal between the cap liner 16 and the body liner 18. The peripheral portion 44 of the cap liner 16 is also firmly in engagement with the upper end of the wall 24 of the container body 12.

Figure 4:
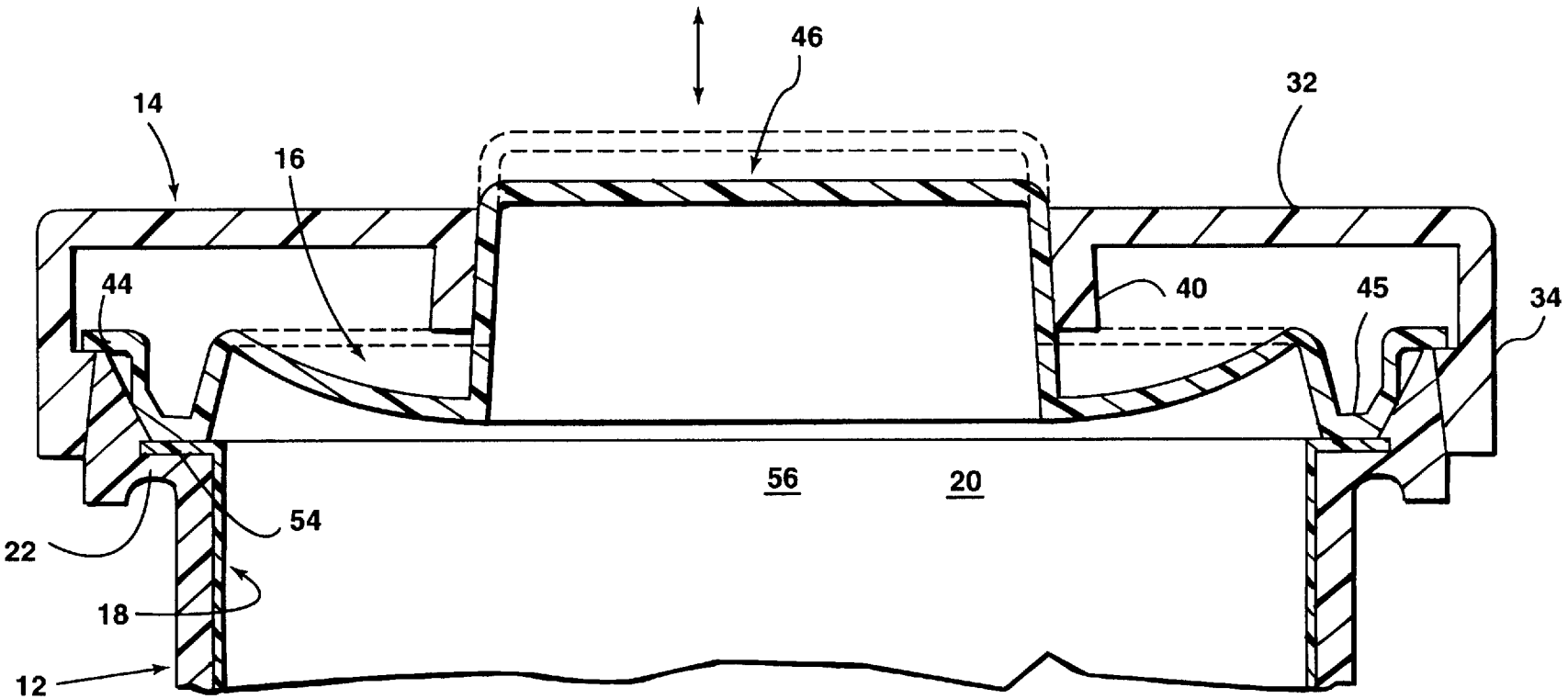
FIG. 4 is a similar view but showing the central button portion pushed downwardly.

Because of the resilience of the cap liner 16, and its tendency to deform uniformly only when pressure is applied directly to its centre, it is not easy for the cap 14 to be pushed down to release all the cap lugs 36 from the container body recess 26 at the same time, thereby rendering the container child resistant. However, it is possible for a person, for example a senior, to push down the central button portion 46 of the cap liner 16, thereby resiliently deforming the cap liner 16 at its centre and pushing it away uniformly from the lower end of the inner wall 40 of the cap 14, as shown in FIG. 4. The cap 14 may then move downwardly or can be easily pushed downwardly to move the cap lugs 36 out of the container body recesses 26. This permits counter-clockwise opening rotation of the cap 14 until the cap lugs 36 have passed the container body ramps 28 and moved into the spaces 29, so that the cap 14 and the cap liner 16 can then be removed from the container body 12, with resultant access to medication in the body liner 18.

During the opening movement, the downward manual pressure on the button portion 46 presses the cap liner 16 even more firmly against the container body wall 24 and the flange 54 of the body liner 18, with the result that the cap liner 16 does not rotate with the cap 14. The rotational movement necessary for the cap 12 to move from the closed position to the open position moves the indicating arrow 60 from one time to the next on the dosage indicator 60

To close the container, the cap 14 and container cap liner 16 are repositioned on the top of the container body 12, and the cap 14 is rotated clockwise until the lugs 36 have become aligned with the spaces 29 adjacent to the ramps 28 on the container body 12. Further cap rotation then causes the lugs 36 to travel along the ramps 28 and then become seated in the recesses 26, thereby closing the container. During this closing movement, the ribs 42 on the cap 14 engage the ratchet teeth 48 on the cap liner 16 to cause the cap liner 16 to rotate with the cap 14.

The cap liner 16 and the body liner 18 can be discarded when all the prescribed medication in the container has been taken, and the cap 14 and container body 12 can be re-used with a new cap liner 16 and a new body liner 18. The cap liner 16 and body liner 18 can therefore be made of a suitable disposable plastic material, and the cap 14 and container body 12 can be made of a more rigid plastic material so that they can be re-used many times.

Figure 7:
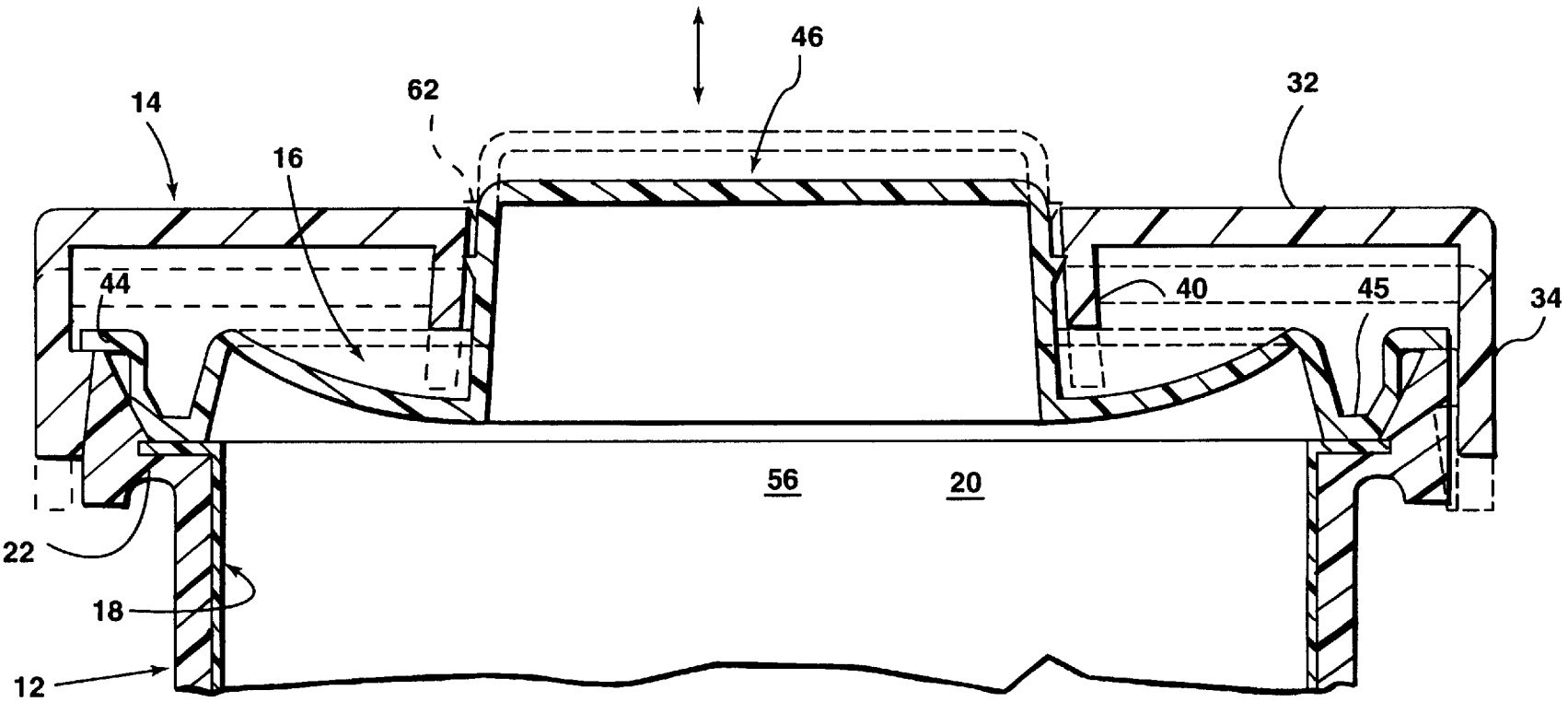
FIG. 7 is similar to FIG. 3 but showing a further embodiment.
Figure 8:
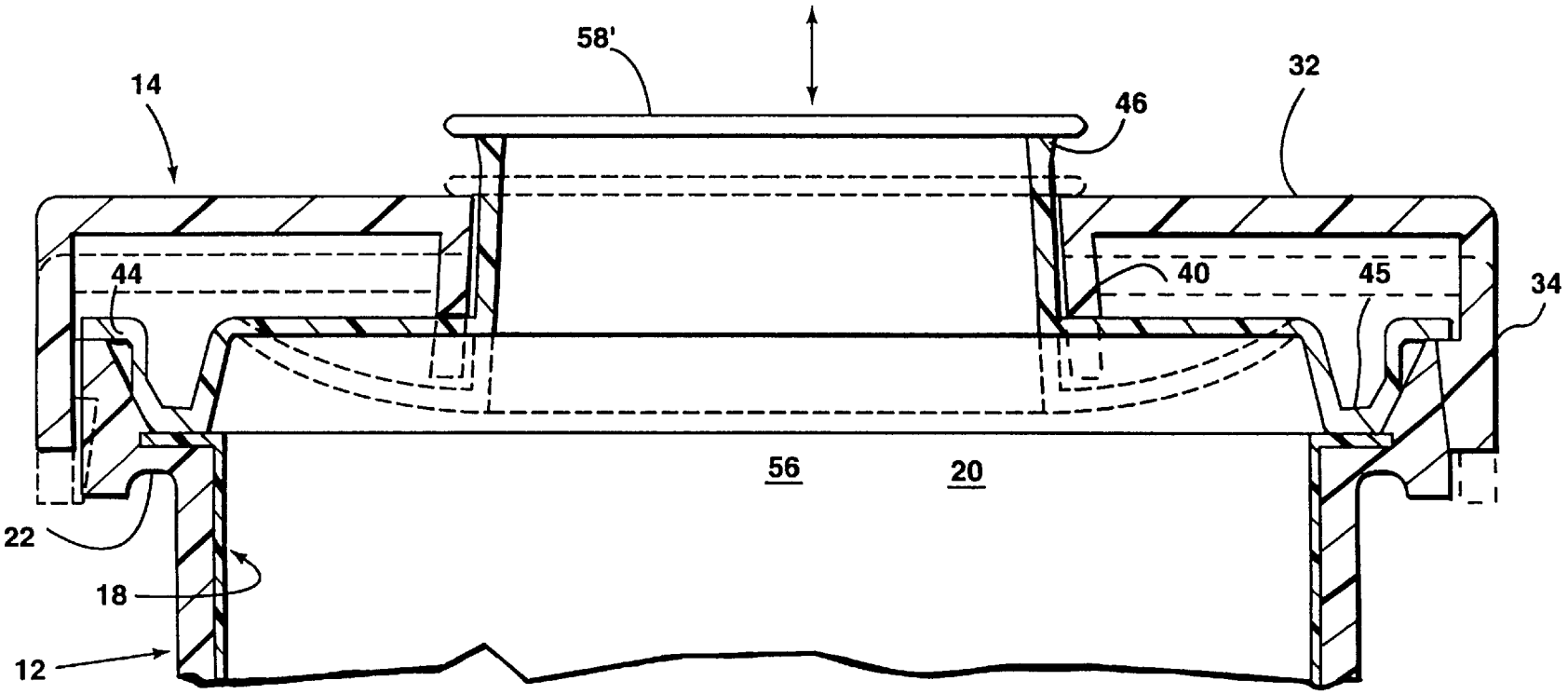
FIG. 8 is a similar view showing a still further embodiment.

As shown in FIG. 7, the button portion 46 may be provided with a circumferential rib 62 which engages the cap 14 when the button portion 46 is pushed downwardly to initiate opening movement and pushes the cap 14 downwardly to move the cap lugs 36 out of the container body recesses 26. Alternatively, as shown in FIG. 8, this may be achieved by providing the dosage indicator 58' with a disc-like plastic member of slightly larger diameter than the diameter of the button portion 46, so that the dosage indicator 58' has an outer circumferential projecting portion 64 which functions in the same manner as the circumferential rib 62 in FIG. 7.

Other advantages and embodiments of the invention will be readily apparent to a person skilled in the art from the foregoing description of a preferred embodiment, the scope of the invention being defined in the appended claims.

I claim:

1. A medication container having:

a tubular container body having an open upper end, a cap detachably securable to the upper end of the container body by clockwise rotation relative thereto, the cap and the container body having mutually engageable stops preventing anti-clockwise opening rotation of the cap relative to the container body when the cap is in an upper position relative to the container body, and a cap liner of resilient material within the cap and having a peripheral portion engageable with the upper end of the container body to close said upper end, the cap liner also having a central button portion projecting upwardly through a central aperture in the cap for manual engagement by a person wishing to open the container, and the cap having a downward extending wall adjacent the aperture and engaged by the cap liner to maintain the cap in the upper position relative to the container body, whereby downward manual pressure on the central button portion of the cap liner causes resilient deformation of the cap liner away from the downwardly extending wall of the cap to permit the cap to be depressed from its upper position and thereby permit counter-clockwise opening rotation of the cap relative to the container body.

2. A medication container according to claim 1 also including a disposable tubular body liner with a closed lower end and an open upper end located within the container body for containing medication, the body liner having a peripheral upper end portion urged against the container body by the cap liner to provide an airtight seal between the cap liner and the body liner.

3. A medication container according to claim 2 wherein the container body has an open lower end.

4. A medication container according to claim 1 wherein the cap and the cap liner have inter-engaging mechanism preventing relative rotational movement therebetween when the cap is rotated in one direction relative to the container body and permitting relative rotational movement therebetween when the cap is rotated in an opposite direction relative to the container body, the cap and the cap liner also having indicia which indicates the next dosage time when the cap is rotated in said opposite direction.

5. A medication container according to claim 1 wherein the button portion has a lateral projection which engages the cap during downward movement of the central button portion to depress the cap from its upper position.

* * * * *